US006260841B1

(12) United States Patent
Tranquilla

(10) Patent No.: US 6,260,841 B1
(45) Date of Patent: Jul. 17, 2001

(54) AUTOMATIC DOCUMENT FEEDER HOPPER FLAG FORCE CONTROL

(75) Inventor: Michael N. Tranquilla, Livonia, MI (US)

(73) Assignee: Unisys Corporation, Blue Bell, PA (US)

( * ) Notice: Subject to any disclaimer, the term of this patent is extended or adjusted under 35 U.S.C. 154(b) by 0 days.

(21) Appl. No.: 09/488,134

(22) Filed: Jan. 20, 2000

(51) Int. Cl.[7] ..... B65H 1/08
(52) U.S. Cl. ..... 271/127; 271/153; 271/155
(58) Field of Search ..... 271/127, 126, 271/149, 150, 152, 153, 154, 155

(56) References Cited

U.S. PATENT DOCUMENTS

| | | | | |
|---|---|---|---|---|
| 4,566,685 | * | 1/1986 | Irvine et al. | 271/155 X |
| 4,723,773 | * | 2/1988 | Westover et al. | 271/155 X |
| 5,971,391 | * | 10/1999 | Salomon et al. | 271/155 X |
| 6,032,946 | * | 3/2000 | Marshall et al. | 271/153 X |

FOREIGN PATENT DOCUMENTS

| | | | | |
|---|---|---|---|---|
| 2037261 | * | 7/1980 | (GB) | 271/153 |

* cited by examiner

*Primary Examiner*—David H. Bollinger
(74) *Attorney, Agent, or Firm*—Rocco L. Adornato; Mark T. Starr; Harness, Dickey & Pierce

(57) ABSTRACT

A document feeder includes a nudger located at a first side of a document stack. The nudger applies a nudger force to the first side of the document stack. An adjustable hopper positions the document stack next to the nudger. The adjustable hopper has a hopper floor that is an inclined plane supporting a flag. The flag adjustably rests against a side of the document stack opposite the nudger and applies a variable flag force to the document stack. The flag force changes according to the incline angle of the hopper floor. The flag has a weight, and as the incline of the hopper floor increases, the flag applies an increasing force caused by the weight to the document stack. The flag force is transmitted through the document stack. The document stack applies a force to the nudger and the nudger applies a reactionary force normal to the nudger. A feedback control is coupled between the nudger and adjustable hopper so that the nudger force can be changed by adjusting the incline of the hopper floor.

12 Claims, 2 Drawing Sheets

AUTOMATIC DOCUMENT FEEDER HOPPER FLAG FORCE CONTROL

BACKGROUND OF THE INVENTION

1. Field of the Invention

The present invention relates generally to a system for providing a consistent force between a nudger and documents fed from a stack. More particularly, the present invention is directed to a system for compensating for variability in a nudger normal force resulting from variations in the number of documents in the stack, the weight of the documents in the stack, and the friction forces between the stack of documents and the hopper floors and walls.

2. Description of Related Art

A variety of automated machines such as document sorters, mail sorters, copiers, page feeders, punch card readers, automatic teller machines and fax machines utilize document feeders to move documents within a machine. Documents in a machine are often stacked and automatically fed from the document stack. A nudger moves the documents a short distance from the leading edge guide to the nip formed by the feed wheel and the separator belt. In the process of successively feeding documents from the stack, a nudger applies a force to a first document, while a flag applies a force to a last document. The flag force is transmitted through the document stack to the nudger, and the nudger, in response, applies a reactionary force normal to the document stack. The nudger, therefore, applies a force which is not only the tangential force caused by the rotation of the nudger about a fixed shaft, but also the reactionary force of the nudger applied in a direction normal to the flag. Commonly known systems for applying the flag force are springs, weights attached to cables and pulleys, incline planes, and motor-driven flags.

A great variety of document friction conditions exist in various applications, such as check processing, mail sorters, punch card readers, automatic teller machines and fax machines. Documents moving against the hopper floor can produce different variations in friction forces. These friction forces generated from the movement of the document stack subtract from the flag force applied to the document stack, thus the force transmitted through the document stack to the nudger is less than the flag force and therefore causes changes in the reactionary force the nudger normally applies to the document stack. A feedback control is required between the flag and nudger to maintain a consistent nudger force that does not vary in response to conditions in the document stack. If the nudger force is too large, the nudger moves multiple documents through the nip, and thus cause multiple feeds. If the nudger force is too low, however, the nudger fails to move documents to the nip, thus the documents do not feed through the nip. There is a need to measure the normal force at the nudger, and depending on this measurement, adjust the flag force to produce a desired nudger force.

SUMMARY OF THE INVENTION

In accordance with the teachings of the present invention, a flag force control system includes a flag which applies a flag force to a side of a document stack opposite the nudger. The flag cooperates with the nudger to force the document stack against the nudger. An adjustable hopper for positioning the document stack next to the nudger includes an adjustable hopper floor which supports a flag. A feedback control is coupled between the nudger and the flag. The feedback control adjusts the nudger force by changing the incline of the adjustable hopper floor.

DETAILED DESCRIPTION OF THE PREFERRED EMBODIMENT

Figure 1:
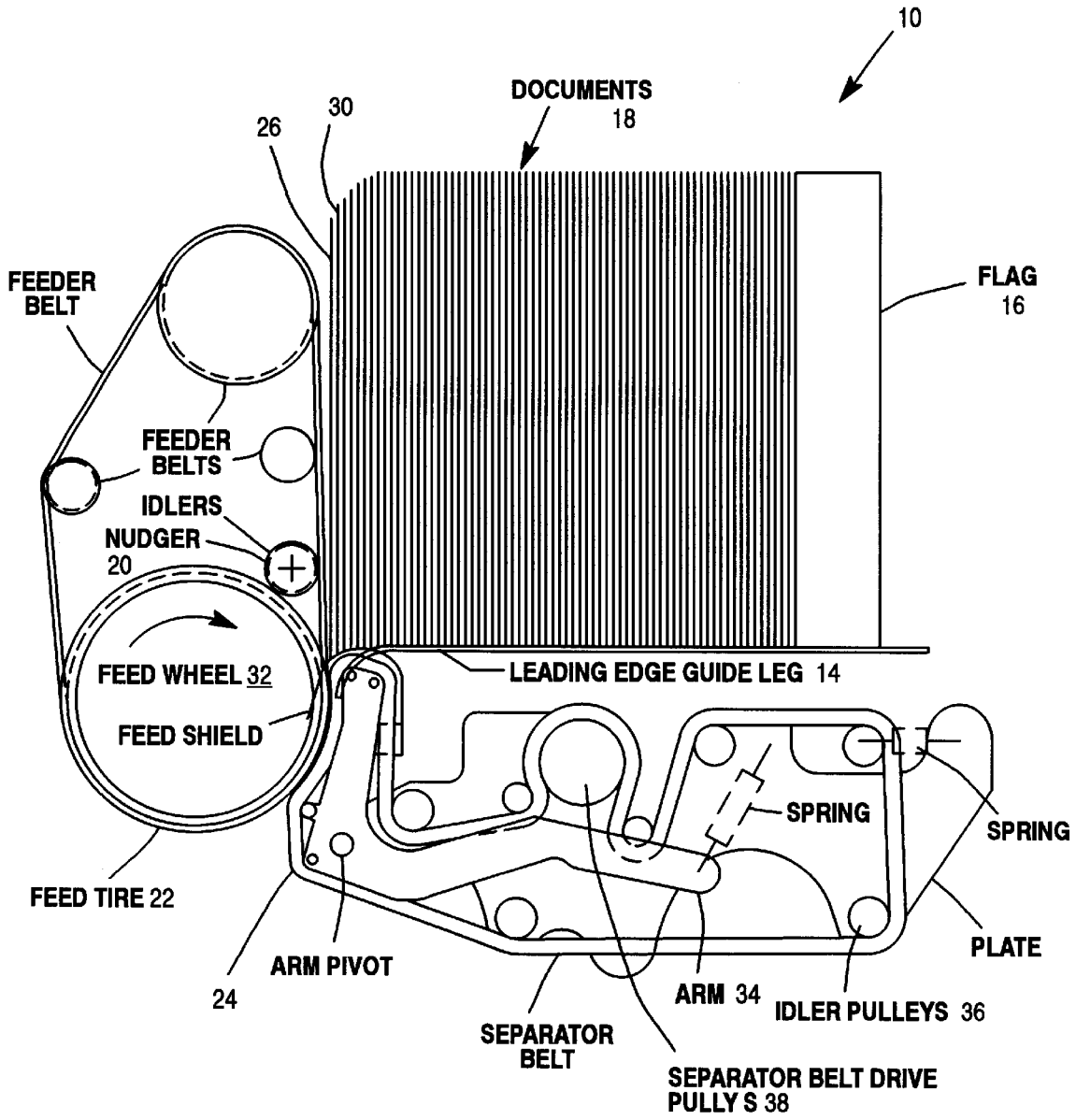
FIG. 1 is a top view of a document feeder.

FIG. 1 shows a document feeder 10. Document feeder 10 has a document leading edge guide wall 14 to support the documents, and a hopper flag 16 to apply a force to a side of a document stack 18 opposite the side of the document stack 18 in contact with nudger 20. A reaction force, normal to the nudger, develops in response to the flag force at the opposite end of document stack 18 where nudger 20 contacts document stack 18. Nudger 20, feeder tire 22 and separator 24 are rotating as a flag pushes document stack 18 along leading edge guide 14, toward nudger 20.

Nudger 20 controls movement of preferably a first document 26 through the feeder/separator nip 28. Nudger 20 and feed tire 22 accelerate first document 26. Nudger 20 moves first document 26 a distance from the leading edge guide 14 to the feeder/separator nip 28 formed by feed tire 22 and separator 24. First document 26 feeds because the friction between the feed tire 22 and first document 26 is greater than the friction between the first document 26 and next document 30. The next document 30 will be held back and not feed as long as the friction between the separator 24 and the next document 30 is greater than the friction between the first document 26 and the next document 30. A nudger force that is too large will push the document through the feed wheel prematurely. Additionally, a nudger force that is too large may cause a document to buckle as it slides on the next document that is waiting for the first document to leave the feeder/separator nip 28. A nudger force that is too low, however, may be unable to move the first document to the feeder/separator nip 28, and thus slip so that no feeding occurs.

In the preferred embodiment, feed tire 22 rotates with feed wheel 32. Separator 24 is supported by arm 34, idler pulleys 36, and separator belt drive pulley 38. Separator 24 is preferably a rotatable belt.

Nudger 20 can be independently driven by a motor drive, preferably a DC servomotor with appropriate feedback controls, a stepper motor, or fast accelerating/decelerating motor. A clutch/brake may also vary the acceleration of nudger 20.

Figure 2:
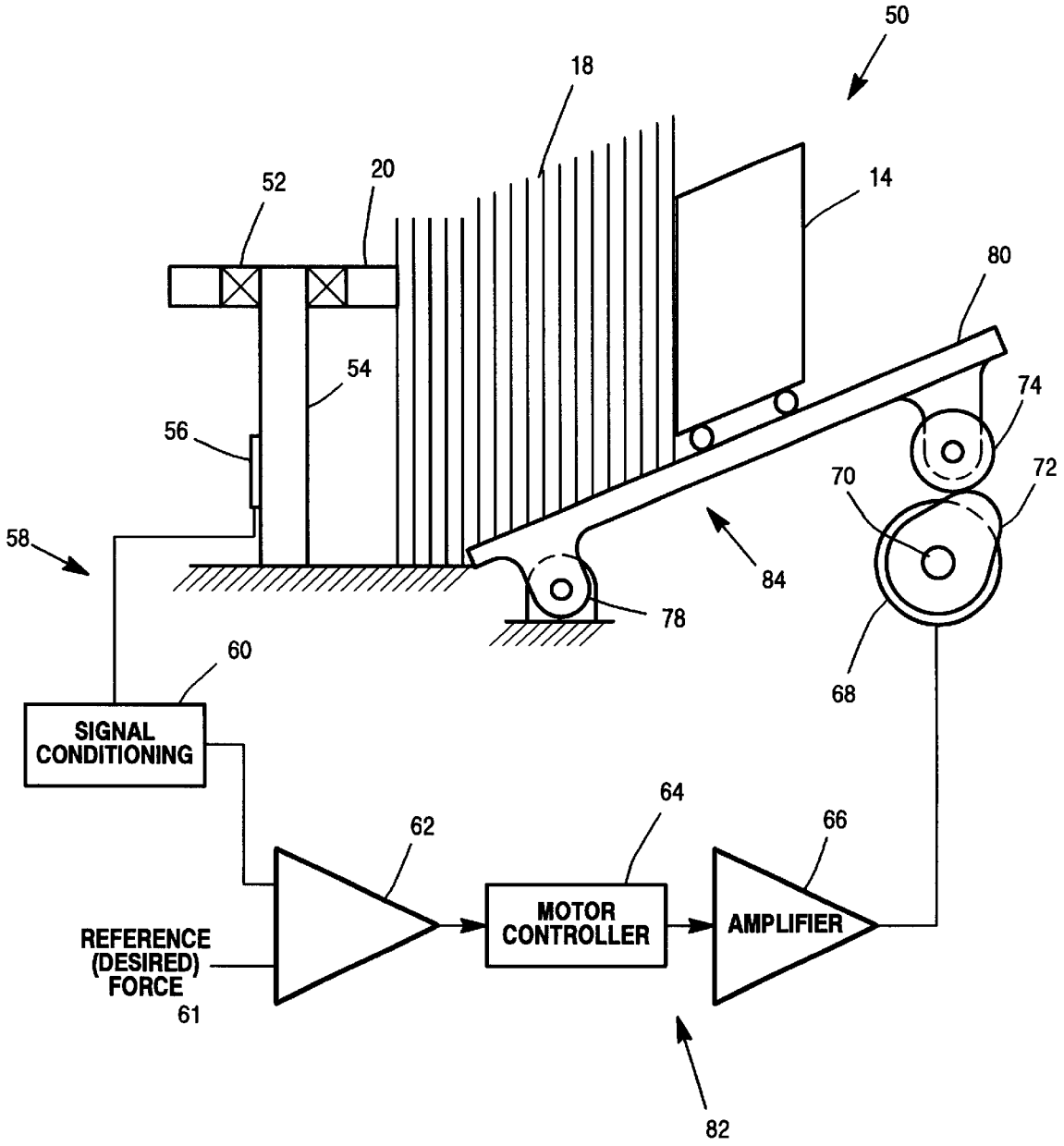
FIG. 2 is a side view showing the preferred embodiment of an automatic hopper flag force control arranged in accordance with the principles of the invention.

FIG. 2 shows an automatic hopper flag force control 50. The nudger 20 is connected to a feedback control 58. Feedback control 58 measures the nudger force which is the force normal to the axis about which nudger 20 rotates, and provides a feedback control signal indicating the difference between the measured nudger force and a reference force which are both provided as signals to the feedback control 58. The reference force is a value desired for the nudger force. The feedback control signal indicates the amount in which the nudger force should be increased or decreased to attain the desired force for the nudger. A drive device 82 is coupled between the feedback control 58 and the adjustable hopper 84. The drive device 82 changes the position of the hopper floor according to the feedback control signal.

A nudger 20 adjustably rests against a first end of the document stack 18. A flag 14 adjustably rests against a second end of the document stack 18. The document stack 18 and flag 14 are supported by the adjustable hopper 84. In the preferred embodiment, the adjustable hopper 84 includes a hopper floor 80 supported by a pivot 78 on a first end. Hopper floor 80 rotates about pivot 78. The flag has a weight that produces a horizontal force against the document stick 18. A change in the incline of the hopper floor 80 changes the horizontal force of the flag 14 applied to document stack 18. The flag 14 preferably has rotational apparatus 86 which permits the flag to move along the hopper floor 80. The horizontal force increases with increasing vertical incline of the hopper floor 80, and decreases with decreasing vertical incline of the hopper floor 80.

In the preferred embodiment, the nudger 20 is rotatably supported on a fixed shaft 54. Bearings 52 are preferably located between nudger 20 and shaft 54. Nudger 20 rotates about shaft 54, and therefore applies a tangential force to the first end of the document stack 18. The nudger 20 also applies a nudger force to the first end of the document stack 18. The nudger force is a reactionary force applied in a direction normal to the axis of rotation of nudger 20. The flag force applies a force to the second end of the document stack 18 causing document stack 18 to apply a force to the nudger 20, thus the nudger applies a nudger force to the document stack 18. The force applied by the document stack 18 to the nudger also bends the shaft 54. This bending of the shaft 54 causes strain in the shaft 54. This strain represents the nudger force.

The feedback control 58 is coupled to the nudger 20. The feedback control 58 obtains a measurement of the nudger force, compares the nudger force to a reference force, and provides a feedback signal representing the change in the nudger force that is needed to obtain the desired nudger force. In the preferred embodiment, the force measurer 56 is a strain gage and is connected to shaft 54. The stain gage measures the strain in the shaft by well-known methods, and provides an electrical signal representing the nudger force. Signal conditioning electronics 60 are connected to the strain gage and convert the resistance change in the strain gage 56 to a voltage. A comparator 62 is connected to signal conditioning electronics 60. Comparator 62 compares the voltage representing the nudger force to a voltage representing the reference force 61 and produces a feedback control signal. The feedback control signal is provided to the drive device 82.

Drive device 82 is coupled between the feedback control 58 and the adjustable hopper 84. In the preferred embodiment, drive device 82 includes a motor controller 64 that drives amplifier 66. Amplifier 66 uses the signal of motor controller 64 to actuate a motor 68. Motor 68 drives a cam 72 that is attached to motor shaft 70. The cam 72 supports a cam roller 74 that is attached to a hopper floor 80. The cam roller 74 causes a change in the position of the incline of the hopper floor. Other drive devices that can be used to change the position of the adjustable hopper include, but are not limited to, a hydraulic cylinder or piston.

If the measured voltage of the strain gage 54 is greater than the voltage representing the desired nudger force, then the drive device will cause a decrease in the incline of the hopper floor 80. If the measured voltage of the strain gage 54 is less than the voltage representing the desired nudger force, then the drive device will cause an increase in the incline of the hopper floor 80. If the measured voltage of strain gage 56 is equal to the voltage representing the desired nudger force, then the motor will turn off. The nudger force can therefore be maintained at the desired force, independently of variations in the document hopper friction forces, or the number of documents in the hopper.

What is claimed is:

1. An apparatus for controlling the nudger force applied to a nudger in a document feeder comprising:

an adjustable flag for applying a force to a side of the document stack opposite the nudger, the flag cooperating with the nudger to force the document stack against the nudger;

a hopper for positioning the document stack next to the nudger, the hopper having an adjustable hopper floor supporting the flag; and a feedback control apparatus coupled between the nudger and the flag for adjusting the hopper floor to vary the nudger force.

2. The apparatus of claim 1 wherein the feedback control apparatus further includes:

a force measurer coupled to the nudger for generating a measured signal representing the nudger force; and a comparator coupled between the force measurer and the adjustable hopper floor, the comparator providing a feedback control signal based on a difference between the signal representing the nudger force and a reference force.

3. The apparatus of claim 2 wherein the nudger is rotationally supported on a fixed shaft and the force measurer comprises a strain gage.

4. The apparatus of claim 2 further including a signal conditioner coupled between the force measurer and the comparator, the signal conditioner for conditioning the measured signal for use with the comparator.

5. The apparatus of claim 1 wherein the adjustable hopper floor further includes a drive device coupled between the feedback control apparatus and the adjustable hopper floor, the drive device for changing an incline of the hopper floor as a function of a control signal generated by the feedback control apparatus.

6. The apparatus of claim 5 wherein the drive device includes a motor controller coupled between the comparator and the drive device, the motor controller for providing the control signal to the drive device.

7. The apparatus of claim 5 wherein the drive device comprises a motor and further includes an amplifier coupled between the motor controller and motor.

8. The apparatus of claim 5 wherein the drive device further includes:

a motor;

a cam connected to the motor; and a cam roller connected to the hopper floor, the cam roller for translating the motion of the cam to the hopper floor.

9. The apparatus of claim 8 wherein the flag is supported by rotational apparatus for providing movement of the flag along the hopper floor.

10. The apparatus of claim 1 wherein the hopper floor is supported by a pivot.

11. An apparatus for controlling force of a nudger against a document stack comprising:

a hopper having an adjustable hopper floor;

a flag resting on the hopper floor for exerting a flag force upon an end of the document stack opposite the nudger;

a force measurer coupled to the nudger for generating a signal representing the nudger force;

a comparator coupled to the force measurer, the comparator for generating a feedback control signal based on a comparison between the generated signal and a reference signal representing a desired force of the nudger; and a drive device coupled between the comparator and the adjustable hopper floor, the drive device operative to change a position of the adjustable hopper floor based on the feedback control signal.

12. The apparatus of claim 11 wherein the drive device further includes:

a motor controller connected to the comparator;

a motor connected to the motor controller;

a cam connected to the motor; and a cam roller fixably connected to the hopper floor, the cam roller for translating the motion of the cam to the hopper.

* * * * *